US007744009B2

(12) United States Patent
Reed et al.

(10) Patent No.: US 7,744,009 B2
(45) Date of Patent: Jun. 29, 2010

(54) RAIL ANCHOR ISOLATOR

(75) Inventors: Martin Earl Reed, Chester, VA (US); James Russell Henderson, Atchison, KS (US); Edwin James Bosshammer, III, Atchison, KS (US)

(73) Assignee: Unit Rail Anchor Company, Atchison, KS (US)

( * ) Notice: Subject to any disclaimer, the term of this patent is extended or adjusted under 35 U.S.C. 154(b) by 330 days.

(21) Appl. No.: 11/784,754

(22) Filed: Apr. 10, 2007

(65) Prior Publication Data

US 2008/0251595 A1 Oct. 16, 2008

(51) Int. Cl.
*E01B 9/00* (2006.01)

(52) U.S. Cl. ..... 238/310; 238/351

(58) Field of Classification Search ..... 238/264, 238/265, 297, 310, 315, 327 R, 351
See application file for complete search history.

(56) References Cited

U.S. PATENT DOCUMENTS 6,829,871 B1 * 12/2004 McSherry et al. ..... 52/705
7,147,169 B2 * 12/2006 Walsh ..... 238/310

* cited by examiner

*Primary Examiner*—S. Joseph Morano
*Assistant Examiner*—Robert J McCarry, Jr.
(74) *Attorney, Agent, or Firm*—Edward J. Brosius

(57) ABSTRACT

The present invention provides an isolator particularly adapted for use with a rail anchor utilized in an application where railroad rail is installed on concrete ties. The isolator protects the concrete tie from contact with the rail anchor caused by longitudinal movement of the rail due to train acceleration of deceleration or expansion and contraction due to temperature changes. In one embodiment, the isolator is comprised of a structural plastic material and includes a front face section and a rear face section. The front face section and rear face section each comprise a generally rectangular structure, having a top edge, bottom edge, and side edges. A center section joins the front face section and rear face section and forms part of the top of the isolator. Ribs extending from the front face and the rear face to aid in positioning the isolator. In another embodiment, the front face section and the rear face section each include positioning tabs projecting therefrom to aid in positioning the isolator.

16 Claims, 4 Drawing Sheets

RAIL ANCHOR ISOLATOR

BACKGROUND OF THE INVENTION

The present invention relates to an isolator for use with a rail anchor and, more particularly, to an isolator for use with a rail anchor applied to railroad rail mounted on concrete ties.

In the installation and operation of railroad rail, the standard rail fastener is a spike driven into a wood tie on either side of the rail. Such arrangement is designed to keep the lateral spacing between rails to maintain gauge distance. Tie plates are also utilized as bearing pads against lateral and vertical forces.

Special problems have arisen due to the use of concrete ties in certain railroad rail installations. One approach to restricting and restraining rail used with concrete ties is shown in U.S. Pat. No. 5,016,816.

The particular problem with railroad rail mounted on concrete ties is longitudinal rail movement when holding is provided with resilient fasteners. Rail anchors can be used to restrict such longitudinal rail movement, which typically occurs during the acceleration and deceleration of trains or the expansion and contraction due to temperature changes. However, abrasions from the steel rail anchor against the concrete tie tend to erode and eventually damage the concrete tie.

Accordingly, it is an object of the present invention to provide an improved isolator for use with a rail anchor, particularly adapted for use with concrete ties.

It is another object of the present invention to provide a rail anchor isolator with improved positioning capabilities.

SUMMARY OF THE INVENTION

The present invention provides an isolator particularly adapted for use with a rail anchor utilized in an application where railroad rail is installed on concrete ties. The isolator protects the concrete tie from longitudinal movement of the rail due to expansion and contraction due to changing temperatures, and the acceleration and deceleration of trains.

In one embodiment, the isolator is comprised of a structural plastic material and includes a front face section and a rear face section. The front face section and rear face section each comprise a generally rectangular structure, having a top edge, bottom edge, and side edges. A center section joins the front face section and rear face section and forms part of the top of the isolator. In another embodiment, the front face section includes a top section and bottom section, with the top section having a lower edge projecting laterally at an acute angle from the bottom section. Similarly, the rear face section includes a top section and a bottom section, with the top section having a lower edge projecting laterally at an acute angle from the bottom section. Both the front face section and rear face section include a positioning rib or positioning tabs on inner surfaces thereof.

The isolator is adapted to receive a rail anchor such that either the front face section or the rear face section of the isolator would contact the concrete tie and thereby isolate the steel rail anchor from the concrete tie.

DETAILED DESCRIPTION OF THE INVENTION

Figure 1:
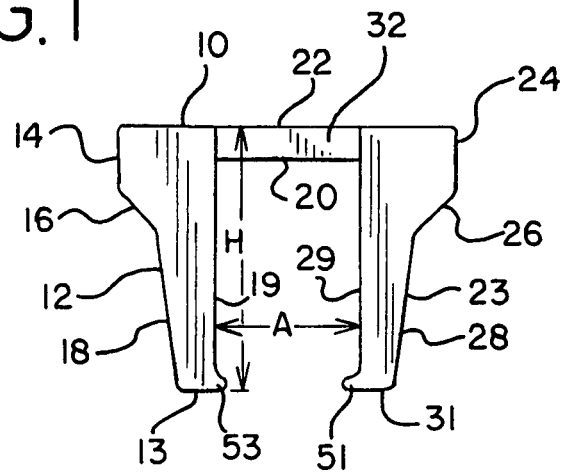
FIG. 1 is an end view of a rail anchor isolator in accordance with an embodiment of the present invention.
Figure 2:
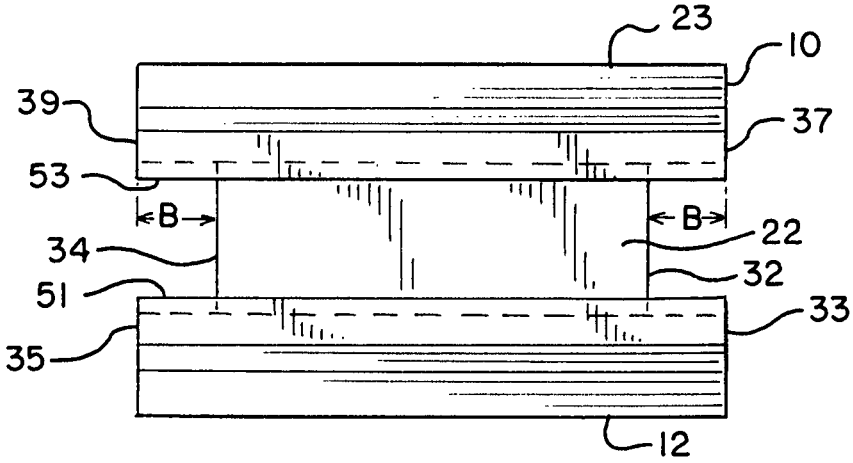
FIG. 2 is a top view of a rail anchor isolator in accordance with an embodiment of the present invention.
Figure 3:
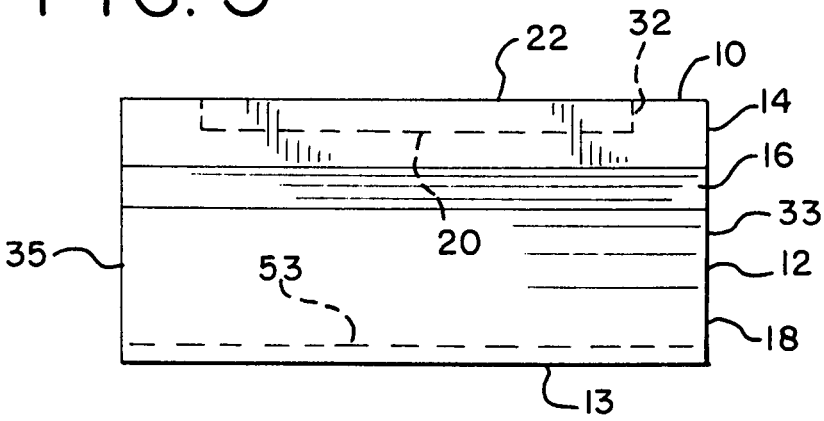
FIG. 3 is a side view, in partial cross-section, of a rail anchor isolator in accordance with an embodiment of the present invention.

Referring now to FIGS. 1-3, a rail anchor isolator is shown generally at 10. Rail anchor isolator 10 is seen to be of a general channel shape in cross-section, and is comprised of front face section 12 and rear face section 23. Center section 20 is seen to extend between and join front face section 12 and rear face section 23. The top surface 22 of center section 20 is seen to be planar with the top surfaces of front face section 12 and rear face section 23 to form a generally flat top surface of rail anchor isolator 10.

Front face section 12 is seen to be a generally elongated, rectangular structure having a top edge, a bottom edge 13, and two side edges 33 and 35. Front face section 12 also includes rib section 14 which extends laterally and includes an angle section 16 that extends from front face section depending lower section 18. Front face section depending lower section 18 is seen to taper to a decreasing thickness toward bottom edge 13.

Similarly, rear face section 23 is seen to be a generally elongated, rectangular structure having a top edge, a bottom edge 31, and two side edges 37 and 39. Rear face section 23 also includes rib section 24 which extends laterally and includes an angle section 26 that extends from front face section depending lower section 28. Rear face section depending lower section 28 is seen to taper to a decreasing thickness toward bottom edge 31.

Front face section 12 inner surface 19 is seen to have a rib 53 extending along its length adjacent bottom edge 13.

Rear face section 23 inner surface 29 is seen to have a rib 51 extending along its length adjacent bottom edge 31.

Front face section 12 is seen to have inner surface 19 and rear face section 23 is seen to have inner surface 29. These surfaces are spaced laterally by a distance A, which is seen to be less than the height of front face section 12, shown as H in FIG. 1.

Center section 20 is seen to have longitudinal edges 32 and 34. These edges are inlet a distance B from the longitudinal edge 33 of front face section 12 and the longitudinal edge 37 of rear face section 23.

Figure 4:
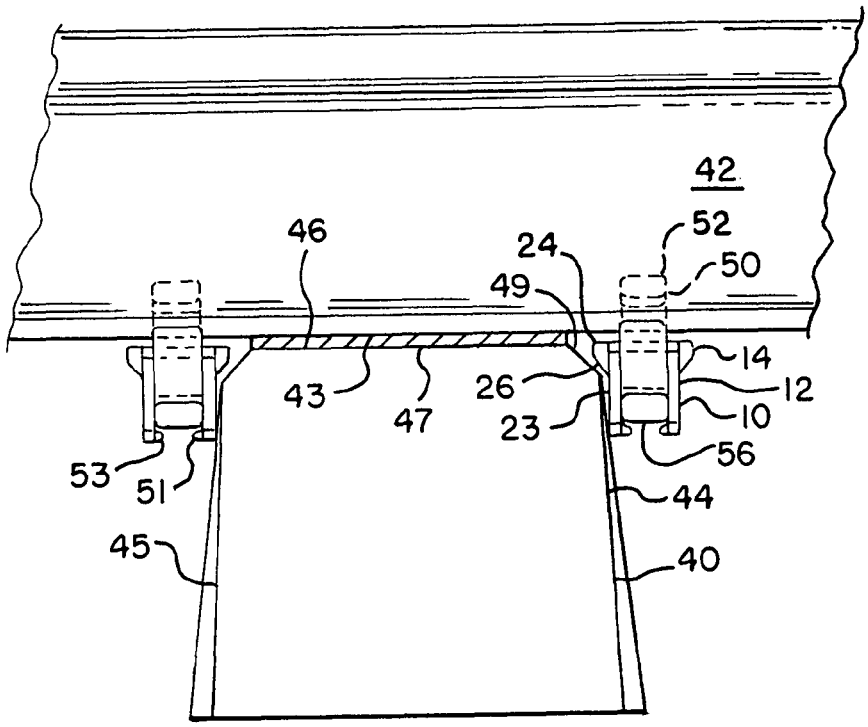
FIG. 4 is an end view, in partial cross-section, of a rail anchor isolator installed on a railroad rail and tie in accordance with an embodiment of the present invention.
Figure 5:
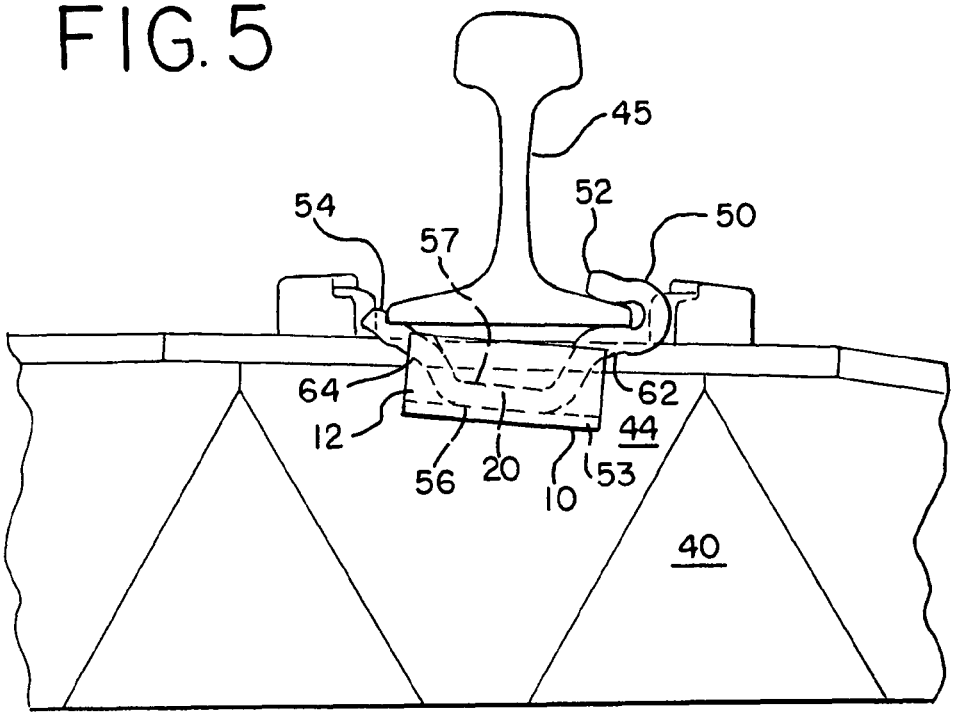
FIG. 5 is an end view of a railroad rail, in partial cross-section, with a rail anchor and rail anchor isolator installed on a railroad tie in accordance with an embodiment of the present invention.
Figure 6:
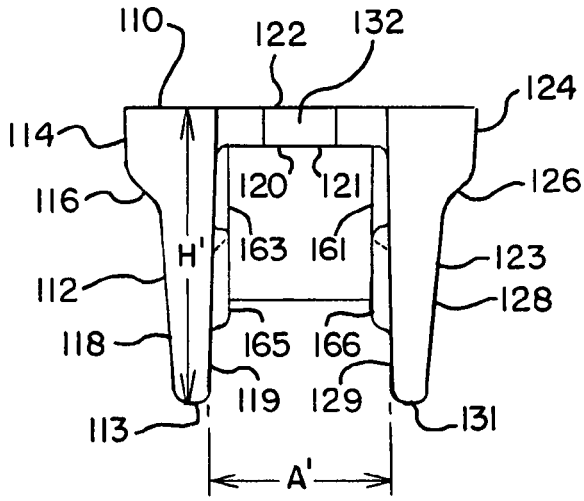
FIG. 6 is an end view of a rail anchor isolator in accordance with a second embodiment of the present invention.
Figure 7:
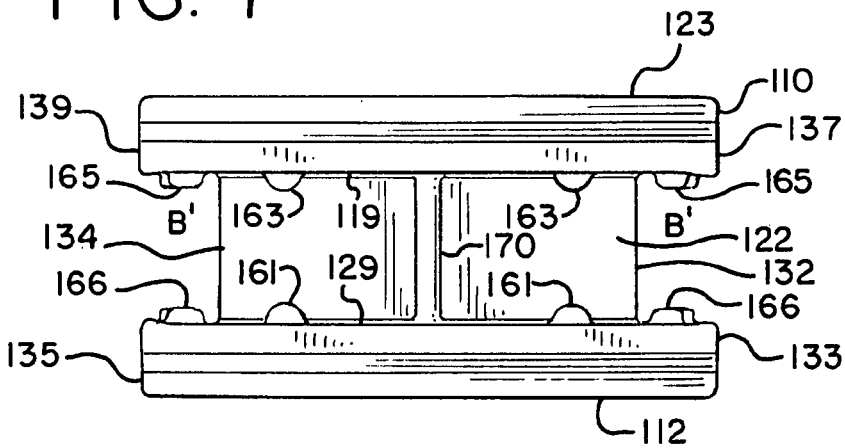
FIG. 7 is a top view of a rail anchor isolator in accordance with a second embodiment of the present invention.
Figure 8:
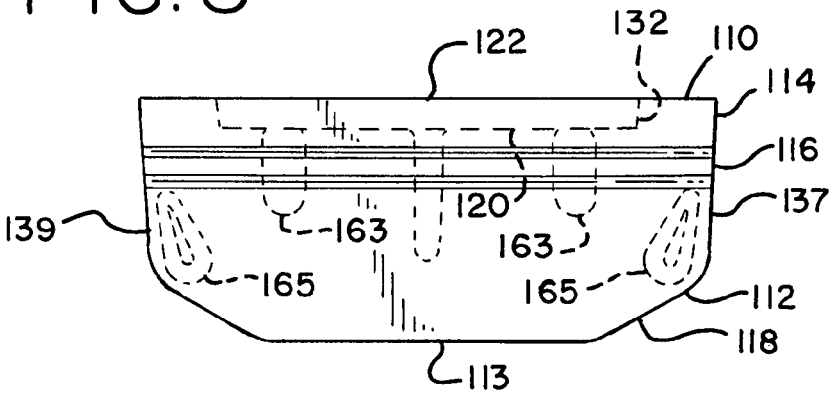
FIG. 8 is a side view, in partial cross-section, of a rail anchor isolator in accordance with a second embodiment of the present invention.

Referring now to FIGS. 4 and 5, a rail isolator 10 in accordance with an embodiment of the present invention is shown in an installation. Such installation includes concrete tie 40, which is a generally elongated rectangular structure, having edges 44 and 45, and top surface 46. A railroad rail is shown at 42 which includes a bottom edge or surface 43. A spacer 47 is provided on top 46 of concrete tie 40 to provide a space and support for rail 42.

A rail anchor 50 is shown as comprising a bent, steel structure having a top end 52 extending to a lower end 54. Rail 42 is seen to be received in rail anchor 50 in a usual fashion. Further, rail anchor 50 includes a lower edge 56 with an upper surface 57 which is spaced below and around rail anchor isolator 10; upper surface 57 contacts or abuts center section 20. It is seen that rear face section 23 provides insulation and spacing between concrete tie side 44 and rail anchor 50. Further, rear face rib section 24 is seen to include angle section 26 which is adjacent a similarly angled section 49 of concrete tie 40.

Rail anchor 50 is seen to have intermediate sections 62 and 64 which fit through a spacing A between inner surface 19 of front face section 12 and inner surface 29 of rear face section 23. This fitting arrangement tends to keep rail isolator 10 in place between rail anchor 50 and concrete tie 40. Front face section 12 rib 53 and rear face section 23 rib 51 are seen to fit around and hold rail anchor 50 lower edge 56.

It should be understood that rail anchor isolator 10 is a unitary device, usually made in an injection molding operation. The preferred material for rail anchor isolator 10 is a structural plastic, usually comprising about half a high density polyethylene, and about half a low density polyethylene component mix.

Referring now to FIGS. 6-8 and 11, a second embodiment to a rail anchor isolator is shown generally at 110. Rail anchor isolator 110 is seen to be of a general channel shape in cross-section, and is comprised of front face section 112 and rear face section 123. Center section 120 is seen to extend between and join front face section 112 and rear face section 123. The top surface 122 of center section 120 is seen to be generally planar with the top surfaces of front face section 112 and rear face section 123 to form a generally flat top surface of rail anchor isolator 110.

Front face section 112 is seen to be a generally elongated, rectangular structure having a top edge, a bottom edge 113, and two side edges 133 and 135. Front face section 112 also includes rib section 114 which extends laterally and includes an angle section 116 that extends from front face section depending lower section 118. Front face section depending lower section 118 is seen to taper to a decreasing thickness toward bottom edge 113.

Similarly, rear face section 123 is seen to be a generally elongated, rectangular structure having a top edge, a bottom edge 131, and two side edges 137 and 139. Rear face section 123 also includes rib section 124 which extends laterally and includes an angle section 126 that extends from front face section depending lower section 128. Rear face section depending lower section 128 is seen to taper to a decreasing thickness toward bottom edge 131.

Front face section 112 is seen to have inner surface 119 and rear face section 123 is seen to have inner surface 129. These surfaces are spaced laterally by a distance A', which is seen to be less than the height of front face section 112, shown as H' in FIG. 6.

A certain support 170 is seen to extend perpendicularly between inner surface 119 and inner surface 129.

Front face section 112 inner surface 119 is seen to have two elongated positioning tabs 163 extending from lower surface 121 of center section 120 to almost halfway down along inner surface 119.

Inner surface 119 also includes two angled positioning tabs 165 located near edges 137 and 139. Positioning tabs 165 are elongated raised structures on inner surface 119 and extend at an acute angle to top surface 122.

Inner surface 129 also includes two angled positioning tabs 166 located near edges 133 and 135. Positioning tabs 166 are elongated raised structures on inner surface 129 and extend at an acute angle to top surface 122.

Rear face section 123 inner surface 129 is seen to have two elongated positioning tabs 161 extending from lower surface 121 of center section 120 to almost halfway down along inner surface 129.

Center section 120 is seen to have longitudinal edges 132 and 134. These edges are inset from inlet a distance B' from the longitudinal edge 133 of front face section 112 and the longitudinal edge 137 of rear face section 123.

Figure 9:
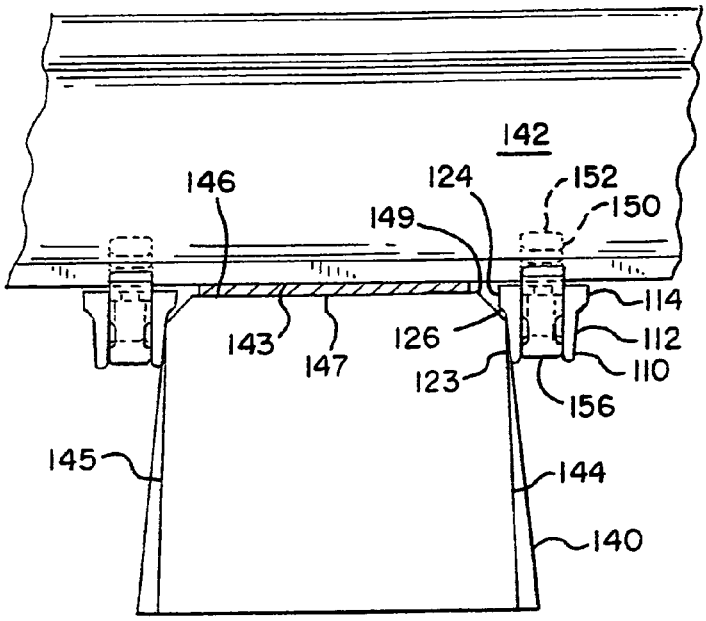
FIG. 9 is an end view, in partial cross-section, of a rail anchor isolator installed on a railroad rail and tie in accordance with a second embodiment of the present invention.
Figure 11:
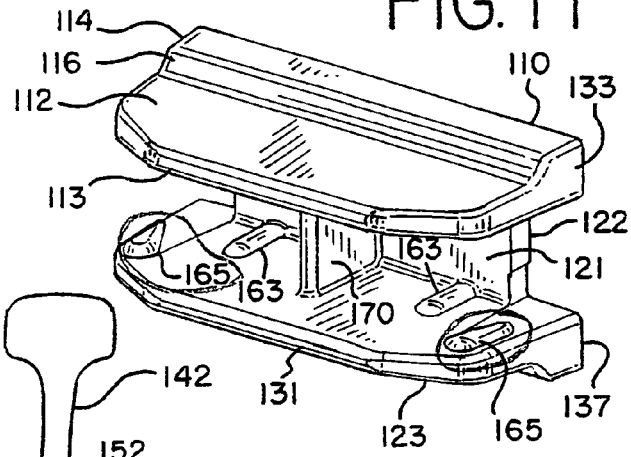
Figure 10:
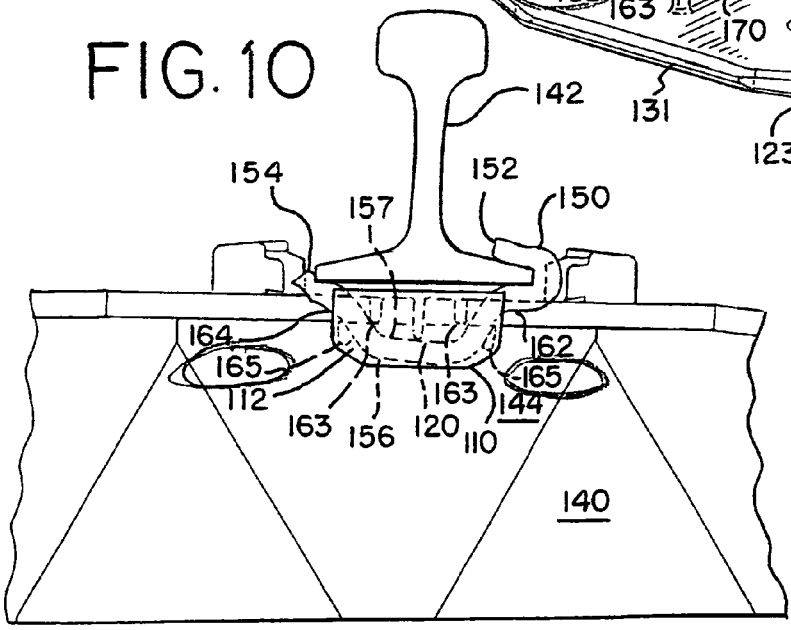
FIG. 10 is an end view of a railroad rail, in partial cross-section, with a rail anchor and rail anchor isolator installed on a railroad tie in accordance with in accordance with a second embodiment of the present invention, and, FIG. 11 is a perspective view of a rail anchor isolator in accordance with a second embodiment of the present invention.

Referring now to FIGS. 9 and 10, a rail isolator 110 in accordance with the second embodiment of the present invention is shown in an installation. Such installation includes concrete tie 140, which is a generally elongated rectangular structure, having edges 144 and 145, and top surface 146. A railroad rail is shown at 142 which includes a bottom edge or surface 143. A' spacer 147 is provided on top 146 of concrete tie 140 to provide a space and support for rail 142.

A rail anchor 150 is shown as comprising a bent, steel structure having a top end 152 extending to a lower end 154. Rail 142 is seen to be received in rail anchor 150 in a usual fashion. Further, rail anchor 150 includes a lower edge 156 with an upper surface 157 which is spaced below and around rail anchor isolator 110; upper surface 157 contacts or abuts center section 120. It is seen that rear face section 123 provides insulation and spacing between concrete tie side 144 and rail anchor 150. Further, rear face rib section 124 is seen to include angle section 126 which is adjacent a similarly angled section 149 of concrete tie 140.

Rail anchor 150 is seen to have intermediate sections 162 and 164 which fit through a spacing A' between inner surface 119 of front face section 112 and inner surface 129 of rear face section 123. This fitting arrangement tends to keep rail isolator 110 in place between rail anchor 150 and concrete tie 140. Front face section 112 tabs 163 and rear face section 123 tabs (not shown) are seen to fit around end hold rail anchor 150 lower edge 156, upper surface 157.

Angled positioning tabs 165 are seen to fit and position against an outer edge of rail anchor 150. Similarly, though not shown, angled positioning tabs 166 fit and position against an opposite outer edge of rail anchor 150.

What is claimed is:

1. An isolator for use with a rail anchor, the isolator comprising:

a structure including a front face section and a rear face section, the front face section comprising a generally rectangular structure, having a top edge, bottom edge and two side edges, the rear face section comprising a generally rectangular structure, having a top edge, bottom edge and two side edges, and a center section that joins the front face section and the rear face section, the center section having a top surface and bottom surface, the front face section also having a support section that extends at an acute angle from an outer surface of the front face section, the front face section also having an inner surface with a first elongated positioning tab extending downwardly from the bottom surface of the center section, the rear face section also having a support section that extends at an acute angle from an outer surface of the rear face section, the rear face section also having an inner surface with a second elongated positioning tab extending downwardly from the bottom surface of the center section, wherein an angled positioning tab extends from the inner surface of the front face section, and the angled positioning tabs is located near a side edge of the front face section.

2. The isolator of claim 1 wherein the first elongated positioning tab extending from the inner surface of the face section extends almost one half the height of the front face section, and wherein the second elongated positioning tab extending from the inner surface of the rear face section extends almost one half the height of the rear face section.

3. The isolator of claim 1 wherein the isolator is a unitary structure comprised of a structural plastic material.

4. The isolator of claim 1 wherein the isolator is comprised of a structural plastic material that is an electrical insulator.

5. The isolator of claim 1 wherein the front face section includes a lower section that depends from the support section and that is of a thickness that tapers from the support section toward the bottom edge.

6. The isolator of claim 1 wherein the rear face section includes a lower section that depends from the support section and is of a thickness that tapers from the support section toward the bottom edge.

7. An isolator for use with a rail anchor, the isolator comprising:

a front face section and a rear face section, the front face section comprising a generally rectangular structure having a top edge, bottom edge and two side edges, the rear face section comprising a generally rectangular structure having a top edge, bottom edge and two side edges, and a center section that joins the front face section, and the rear face section, the center section having a bottom surface, the front face section including an inner surface with a first elongated positioning tab extending downwardly from the bottom surface of the center section, the rear face section including an inner surface with a second elongated positioning tab extending downwardly from the bottom surface of the center section, wherein an angled positioning tab extends from the inner surface of the front face section, and the angled positioning tab is located near a side edge of the front face section.

8. The isolator of claim 7 wherein there are two elongated positioning tabs extending from the inner surface of the front face section that are laterally spaced from each other, and there are two elongated positioning tabs extending from the inner surface of the rear face section that are laterally spaced from each other.

9. The isolator of claim 7 wherein the isolator is a unitary structure comprised of a structural plastic material.

10. The isolator of claim 7 wherein the isolator is comprised of a structural plastic material that is an electrical insulator.

11. The isolator of claim 7 wherein the front face section includes a top section and a bottom section and the bottom section of the front face section depends from the top section, and the bottom section of the front face section is of a thickness that tapers from the lower edge of the top section toward the bottom edge.

12. The isolator of claim 7 wherein the rear face section includes a top section and a bottom section and the bottom section of the rear face section depends from the top section, and the bottom section of the rear face section is of a thickness that tapers from the lower edge of the top section toward the bottom edge.

13. The isolator of claim 7 wherein the center section extends for less than the entire length of the front face section and the rear face section.

14. The isolator of claim 7 wherein the center section, the front face section and the rear face section form an opening at each end of the isolator.

15. An isolator for use with a rail anchor, the isolator comprising:

a structure including a front face section and a rear face section, the front face section comprising a generally rectangular structure, having a top edge, bottom edge and two side edges, the rear face section comprising a generally rectangular structure, having a top edge, bottom edge and two side edges, and a center section that joins the front face section and the rear face section, the center section having a top surface and bottom surface, the front face section also having a support section that extends at an acute angle from an outer surface of the front face section, the front face section also having an inner surface with a first elongated positioning tab extending downwardly from the bottom surface of the center section, the rear face section also having a support section that extends at an acute angle from an outer surface of the rear face section, the rear face section also having an inner surface with a second elongated positioning tab extending downwardly from the bottom surface of the center section, wherein an angled positioning tab extends from the inner surface of the rear face section, and the angled positioning tab is located near a side edge of the rear face section.

16. An isolator for use with a rail anchor, the isolator comprising:

a front face section and a rear face section, the front face section comprising a generally rectangular structure having a top edge, bottom edge and two side edges, the rear face section comprising a generally rectangular structure having a top edge, bottom edge and two side edges, and a center section that joins the front face section, and the rear face section, the center section having a bottom surface, the front face section including an inner surface with a first elongated positioning tab extending downwardly from the bottom surface of the center section, the rear face section including an inner surface with a second elongated positioning tab extending downwardly from the bottom surface of the center section, wherein an angled positioning tab extends from the inner surface of the rear face section, and the angled positioning tab is located near a side edge of the rear face section.

* * * * *